US010987923B2

(12) United States Patent
Sato

(10) Patent No.: US 10,987,923 B2
(45) Date of Patent: Apr. 27, 2021

(54) LIQUID CIRCULATION DEVICE AND LIQUID DISCHARGE DEVICE

(71) Applicant: TOSHIBA TEC KABUSHIKI KAISHA, Tokyo (JP)

(72) Inventor: Tetsuya Sato, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/550,504

(22) Filed: Aug. 26, 2019

(65) Prior Publication Data

US 2020/0114644 A1 Apr. 16, 2020

(30) Foreign Application Priority Data

Oct. 12, 2018 (JP) ..... JP2018-193691

(51) Int. Cl.
*B41J 2/045* (2006.01)

(52) U.S. Cl.
CPC ..... *B41J 2/04563* (2013.01); *B41J 2/0458* (2013.01); *B41J 2/04581* (2013.01)

(58) Field of Classification Search
CPC ..... B41J 2/04563; B41J 2/18; B41J 2/17596; B41J 2/17509; B41J 2/175; B41J 2/17513; B41J 2/17556; B41J 2/0454; B41J 2/04553; B41J 2202/12
See application file for complete search history.

(56) References Cited

U.S. PATENT DOCUMENTS 9,815,287 B2 11/2017 Moriguchi et al.
2009/0102879 A1* 4/2009 Katada et al. ..... B41J 2/17513
2011/0025751 A1 2/2011 Hashi
2015/0070429 A1* 3/2015 Takahashi et al. .... B41J 2/0454
2016/0001566 A1 1/2016 Shibata
2016/0368274 A1 12/2016 Ohtsu et al.
2017/0217164 A1 8/2017 Kaneko et al.

FOREIGN PATENT DOCUMENTS

JP 2011-051170 3/2011
JP 2014-079885 5/2014
JP 2014-144611 8/2014
WO 2016/208533 12/2016

OTHER PUBLICATIONS

Extended European Search Report for European Patent Application No. 19198660.3 dated Feb. 21, 2020.

* cited by examiner

*Primary Examiner* — Thinh H Nguyen
(74) *Attorney, Agent, or Firm* — Amin, Turocy & Watson, LLP

(57) ABSTRACT

A liquid circulation device includes a first pipe, a first pump, a first portion, a second pipe, a second pump, a second portion, and a heater. A secondary side of the first pipe is connected to a liquid discharge head. The first pump is provided midway through the first l pipe. The first portion is provided midway through the first pipe on a secondary side of the first pump, and includes a flow channel cross-sectional area larger than the area of the first pipe. A primary side of the second pipe is connected to the head. The second pump is provided midway through the second pipe. The second portion is provided midway through the second pipe on a primary side of the second pump, and includes a flow channel cross-sectional area larger than the area of the second pipe. The heater is provided on a primary side of the head.

17 Claims, 6 Drawing Sheets

LIQUID CIRCULATION DEVICE AND LIQUID DISCHARGE DEVICE

CROSS-REFERENCE TO RELATED APPLICATION

This application is based upon and claims the benefit of priority from Japanese Patent Application No. 2018-193691, filed on Oct. 12, 2018 the entire contents of which are incorporated herein by reference.

FIELD

Embodiments described herein relate generally to a liquid circulation device, a liquid discharge device, and an inkjet printer.

BACKGROUND

In the related arts, a liquid discharge device which includes a liquid circulation device configured to circulate a liquid such as an ink and jets the liquid from a liquid discharge head to a recording medium such as a paper sheet is known. In the liquid discharge device, for the purpose of improving printing performance and the like, a configuration including a heater that heats the liquid to make viscosity suitable for discharging the liquid is also known. In the liquid circulation device including the heater, a temperature sensor is provided at the same part as a heating unit of the heater, a temperature of the liquid flowing into the liquid discharge head is assumed, and the heater is controlled based on the assumed value.

DETAILED DESCRIPTION

Embodiments provide a liquid circulation device and a liquid discharge device capable of heating a liquid to an appropriate temperature.

In general, according to one embodiment, a liquid circulation device includes a first flow channel pipe, a first pump, a first diameter expanded portion, a second flow channel pipe, a second pump, a second diameter expanded portion, and a heater. A secondary side of the first flow channel pipe is connected to a liquid discharge head configured to discharge a liquid. The first pump is provided midway through the first flow channel pipe. The first diameter expanded portion is provided midway through the first flow channel pipe on a secondary side of the first pump, and formed to include a flow channel cross-sectional area larger than a flow channel cross-sectional area of the first flow channel pipe. A primary side of the second flow channel pipe is connected to the liquid discharge head. The second pump is provided midway through the second flow channel pipe. The second diameter expanded portion is provided midway through the second flow channel pipe on a primary side of the second pump, and formed to include a flow channel cross-sectional area larger than a flow channel cross-sectional area of the second flow channel pipe. The heater is provided on a primary side of the liquid discharge head and configured to heat the liquid.

Figure 1:
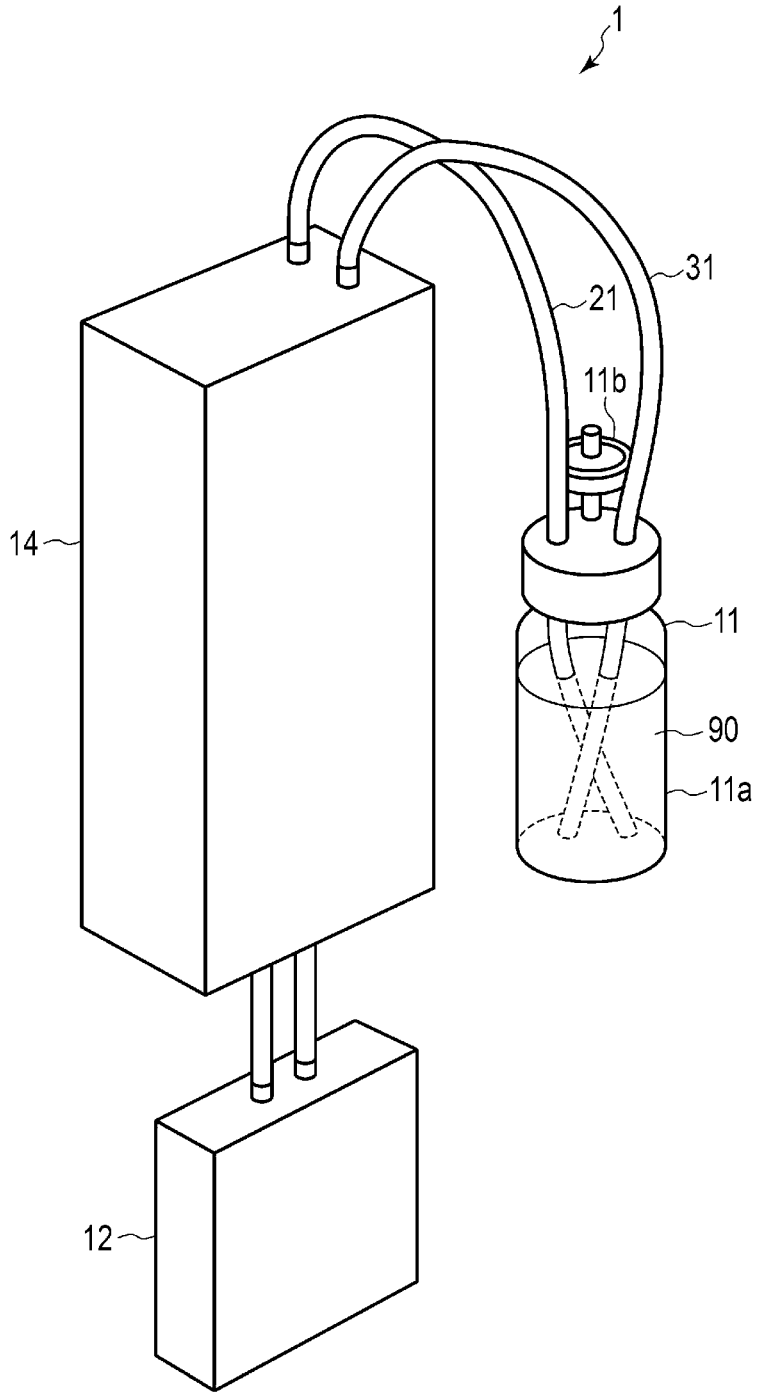
FIG. 1 is a perspective diagram illustrating a configuration of an ink jet recording apparatus according to a first embodiment.
Figure 2:
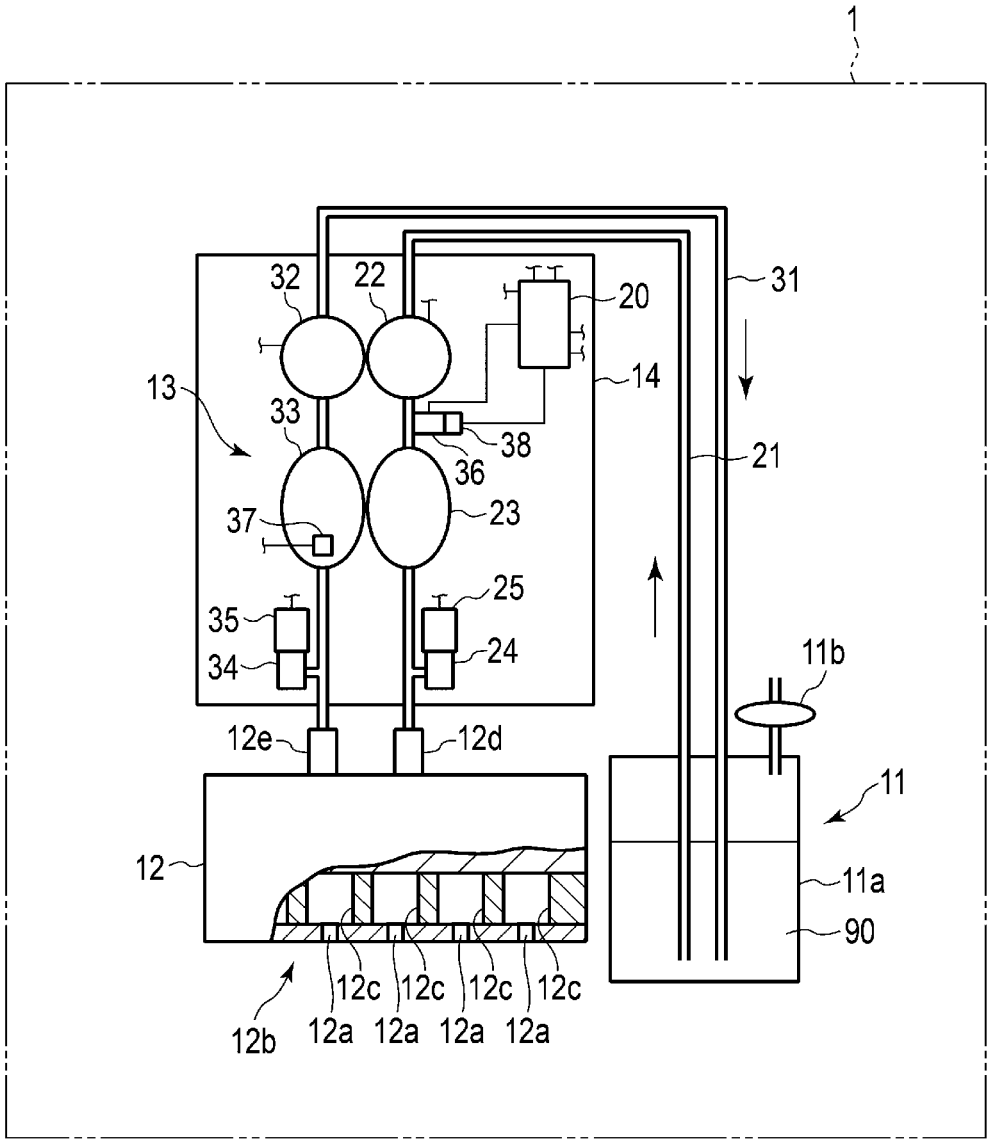
FIG. 2 is an explanatory diagram illustrating the configuration of the ink jet recording apparatus.
Figure 3:
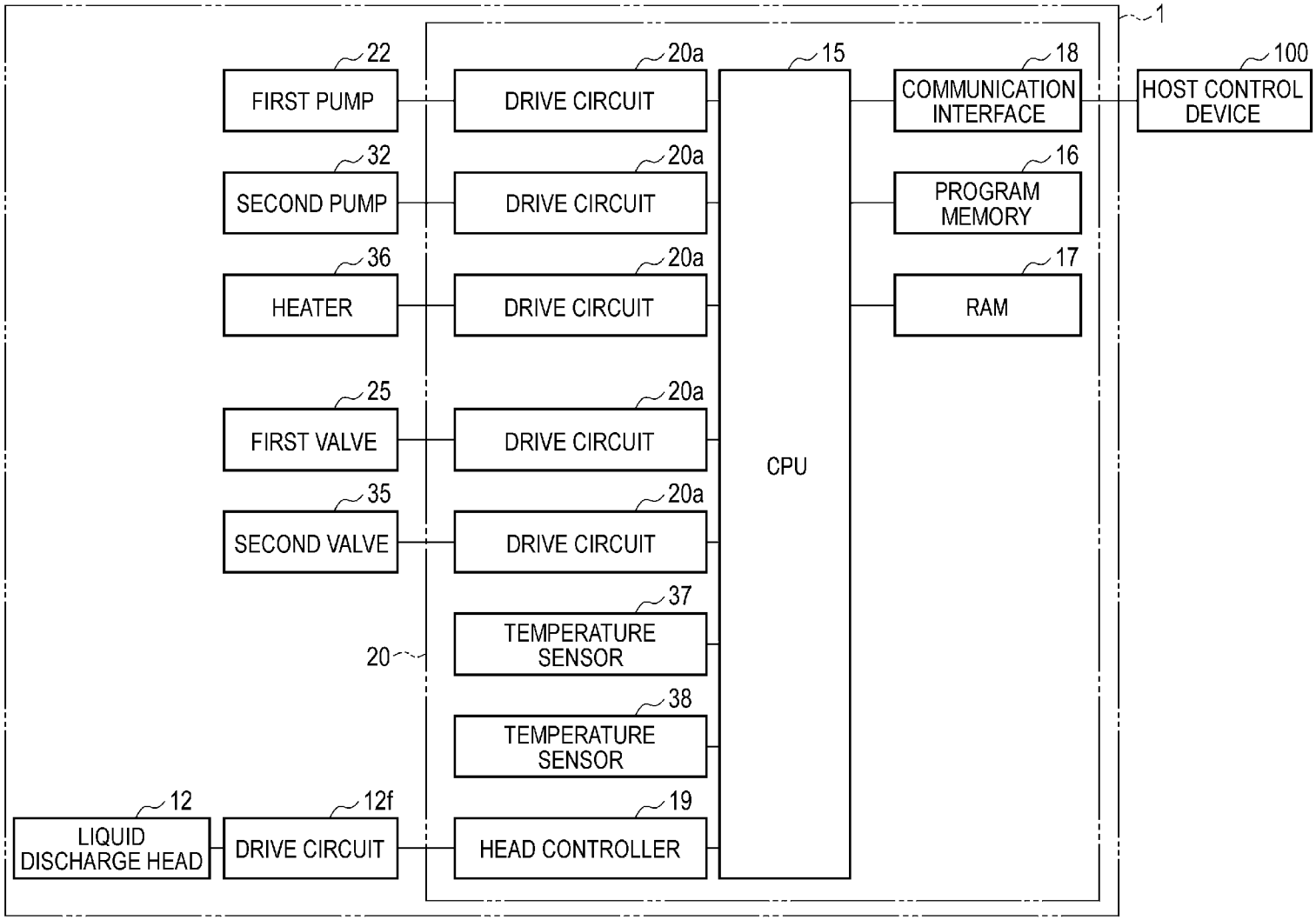
FIG. 3 is a block diagram illustrating the configuration of the ink jet recording apparatus.

Hereinafter, an ink jet recording apparatus (liquid discharge device) 1 according to a first embodiment using an ink circulation device (liquid circulation device) 13 will be described with reference to FIGS. 1 to 3. FIG. 1 is a perspective diagram illustrating a configuration of the ink jet recording apparatus 1 according to the first embodiment. FIG. 2 is an explanatory diagram illustrating the configuration of the ink jet recording apparatus 1. FIG. 3 is a block diagram illustrating the configuration of the ink jet recording apparatus 1.

As illustrated in FIGS. 1 to 3, the ink jet recording apparatus 1 includes one or more tanks 11, a liquid discharge head 12, the ink circulation device 13 configured to circulate an ink (liquid) 90 between the tank 11 and the liquid discharge head 12, a case 14 configured to contain the ink circulation device 13, a central processing unit (CPU) 15 that is a processor (a control unit), a program memory 16, a random access memory (RAM) 17, a communication interface (I/F) 18, a head controller 19, and a control board 20.

The number of the tanks 11 to be provided is the same as the number of types of the ink 90 to be discharged by the ink jet recording apparatus 1. Here, the types of the ink 90 refer to a color, a characteristic, and the like of the ink 90. In the present embodiment, descriptions are given of the ink jet recording apparatus 1 configured to discharge one color of the ink 90. Therefore, one tank 11 is provided. For example, the tank 11 is filled with the ink 90 and attached to the ink circulation device 13. The tank 11 may be a container used repeatedly, capable of being refilled with the ink 90 when a remaining amount of the ink 90 decreases. The tank 11 may be a disposable type container, which is replaced with a container filled with the ink 90 when the remaining amount of the ink 90 decreases.

As illustrated in FIGS. 1 and 2, the tank 11 includes a tank body 11*a* and an air filter 11*b* provided on the tank body 11*a*. The tank body 11*a* communicates with an atmosphere via the air filter 11*b*.

The liquid discharge head 12 discharges one or two colors of the inks 90. In the present embodiment, the ink jet recording apparatus 1 is configured to discharge one color of the ink 90. Therefore, the liquid discharge head 12 configured to discharge one color of the ink 90 will be described. The liquid discharge head 12 includes one or more rows of nozzle arrays 12*b* in which a plurality of nozzle holes 12*a* are arranged in one direction. For example, in the liquid discharge head 12, an actuator including a piezoelectric element or a diaphragm is driven, a plurality of pressure chambers 12*c* of the actuator disposed to be opposed to a nozzle plate including the nozzle array 12*b*. Accordingly, the liquid discharge head 12 jets the ink 90 of the pressure chamber 12*c* to a recording medium from the nozzle holes 12*a* opposed to the pressure chambers 12*c*.

As illustrated in FIG. 2, the liquid discharge head 12 internally includes an ink flow channel configured to supply the ink 90 to each pressure chamber 12*c*, a supply port 12*d* provided on a primary side of the ink flow channel, and a discharge port 12*e* provided on a secondary side of the ink flow channel. One or more of the supply port 12*d* and the discharge port 12*e* are provided depending on the number of the nozzle holes 12*a* or the number of rows of the nozzle arrays 12*b*. The liquid discharge head 12 is disposed, for example, in a posture in which the plurality of nozzle holes 12*a* opens downward in a direction of gravity.

As illustrated in FIG. 2, the ink circulation device 13 includes a first flow channel pipe 21, a first pump 22, a first diameter expanded portion 23, a first pressure sensor 24, a first valve 25, a second flow channel pipe 31, a second pump 32, a second diameter expanded portion 33, a second pressure sensor 34, a second valve 35, a heater 36, a first temperature sensor 37, and a second temperature sensor 38.

As illustrated in FIGS. 1 and 2, a primary side of the first flow channel pipe 21 is connected to the tank 11, and a secondary side thereof is connected to the supply port 12*d* of the liquid discharge head 12. The first flow channel pipe 21 is, for example, a tube formed of a resin material. The first flow channel pipe 21 is configured of, for example, a plurality of tubes formed to have a predetermined length, and the tubes can be connected to respective components by so-called pipe connection.

The first pump 22 is, for example, a diaphragm pump. The first pump 22 supplies the ink 90 of the tank 11 to the liquid discharge head 12. The first pump 22 is provided midway through the first flow channel pipe 21.

As illustrated in FIG. 2, the first diameter expanded portion 23 is provided midway through the first flow channel pipe 21 on a secondary side of the first pump 22. The first diameter expanded portion 23 is formed such that a flow channel cross-sectional area perpendicular to a flow direction of the ink 90 is larger than a flow channel cross-sectional area of the first flow channel pipe 21 perpendicular to the flow direction of the ink 90, and the first diameter expanded portion 23 is formed to have a predetermined length in the flow direction of the ink 90. That is, the first diameter expanded portion 23 forms a liquid chamber of which a flow channel cross-sectional area is larger than the flow channel cross-sectional area of the first flow channel pipe 21, between the first pump 22 and the liquid discharge head 12. The first diameter expanded portion 23 reduces pulsation of the ink 90 which is discharged from the first pump 22 on the primary side to be supplied from the first flow channel pipe 21 to the liquid discharge head 12. The liquid chamber formed by the first diameter expanded portion 23 may have a cylindrical shape, a rectangular columnar shape, or any other shape, as long as the pulsation of the ink 90 can be reduced. The first diameter expanded portion 23 is, for example, disposed side by side with the first pump 22 along the direction of gravity.

As illustrated in FIG. 2, the first pressure sensor 24 is provided on the first flow channel pipe 21 on a secondary side of the first diameter expanded portion 23. The first pressure sensor 24 detects a pressure of the ink 90 of the first flow channel pipe 21 on the secondary side of the first diameter expanded portion 23.

As illustrated in FIG. 2, the first valve 25 is provided on the first flow channel pipe 21 on the secondary side of the first diameter expanded portion 23. For example, the first valve 25 is provided between the first flow channel pipe 21 and the first pressure sensor 24. The first valve 25 is a solenoid valve that opens and closes a flow channel of the first flow channel pipe 21 on the secondary side of the first diameter expanded portion 23. The first valve 25 is a pressure adjustment mechanism that adjusts the pressure in the first flow channel pipe 21 by opening and closing.

As illustrated in FIGS. 1 and 2, a primary side of the second flow channel pipe 31 is connected to the discharge port 12*e* of the liquid discharge head 12, and a secondary side thereof is connected to the tank 11. The second flow channel pipe 31 is, for example, a tube formed of a resin material. The second flow channel pipe 31 is configured of, for example, a plurality of tubes formed to have a predetermined length, and the tubes can be connected to respective components by so-called pipe connection.

The second pump 32 is, for example, a diaphragm pump. The second pump 32 returns the ink 90, which flows in the ink flow channel in the liquid discharge head 12 and is not discharged by the liquid discharge head 12, to the tank 11. The second pump 32 is provided midway through the second flow channel pipe 31.

As illustrated in FIG. 2, the second diameter expanded portion 33 is provided midway through the second flow channel pipe 31 on a primary side of the second pump 32. The second diameter expanded portion 33 is formed such that a flow channel cross-sectional area perpendicular to the flow direction of the ink 90 is larger than a flow channel cross-sectional area of the second flow channel pipe 31 perpendicular to the flow direction of the ink 90, and the second diameter expanded portion 33 is formed to have a predetermined length in the flow direction of the ink 90. That is, the second diameter expanded portion 33 forms a liquid chamber of which a flow channel cross-sectional area is larger than the flow channel cross-sectional area of the second flow channel pipe 31, between the liquid discharge head 12 and the second pump 32. The second diameter expanded portion 33 reduces the pulsation of the ink 90 which was discharged from the liquid discharge head 12 and sucked into the second pump 32 on a secondary side. The liquid chamber formed by the second diameter expanded portion 33 may have a cylindrical shape, a rectangular columnar shape, or any other shape, as long as the pulsation of the ink 90 can be reduced. The second diameter expanded portion 33 is, for example, disposed side by side with the second pump 32 along the direction of gravity.

As illustrated in FIG. 2, the second pressure sensor 34 is provided on the second flow channel pipe 31, on a secondary side of the liquid discharge head 12 and a primary side of the second diameter expanded portion 33. The second pressure sensor 34 detects a pressure of the ink 90 of the second flow channel pipe 31, on the secondary side of the liquid discharge head 12 and the primary side of the second diameter expanded portion 33.

As illustrated in FIG. 2, the second valve 35 is provided on the second flow channel pipe 31, on the secondary side of the liquid discharge head 12 and the primary side of the second diameter expanded portion 33. For example, the second valve 35 is provided between the second flow channel pipe 31 and the second pressure sensor 34. The second valve 35 is a solenoid valve that opens and closes a flow channel of the second flow channel pipe 31 on the secondary side of the second diameter expanded portion 33. The second valve 35 is a pressure adjustment mechanism that adjusts the pressure in the second flow channel pipe 31 by opening and closing.

The heater 36 includes a heating unit configured to heat a heating object by generating heat. The heating unit of the heater 36 is attached to the heating object. As illustrated in FIG. 2, the heater 36 is provided on the secondary side of the first pump 22 and a primary side of the supply port 12*d* of the liquid discharge head 12. As a specific example, the heater 36 is provided on the first flow channel pipe 21, on the secondary side of the first pump 22 and a primary side of the first diameter expanded portion 23. The heater 36 heats the ink 90 flowing through the first flow channel pipe 21 by heating the first flow channel pipe 21.

As illustrated in FIG. 2, the first temperature sensor 37 is provided on a secondary side of the discharge port 12*e* of the liquid discharge head 12 and a primary side of the second pump 32. For example, the first temperature sensor 37 is provided on the second diameter expanded portion 33 and detects the temperature of the ink 90 in the second diameter expanded portion 33. As illustrated in FIG. 3, the first temperature sensor 37 is electrically connected to the CPU 15, and transmits detected temperature information (a detected value) to the CPU 15 as an electric signal. The first temperature sensor 37 is, for example, a thermistor.

As illustrated in FIG. 2, the second temperature sensor 38 is provided on the heater 36. The second temperature sensor 38 detects the temperature of the heater 36. As illustrated in FIG. 3, the second temperature sensor 38 is electrically connected to the CPU 15, and transmits detected temperature information (a detected value) to the CPU 15 as an electric signal. The second temperature sensor 38 is, for example, a thermistor.

As illustrated in FIGS. 1 and 2, the case 14 is formed to have a rectangular parallelepiped shape having a predetermined volume of a containing space therein. The case 14 contains each component except for both ends of the first flow channel pipe 21 and the second flow channel pipe 31 of the ink circulation device 13, respectively connected to the tank 11 and the liquid discharge head 12.

As illustrated in FIG. 3, the CPU 15 controls, for example, the whole ink jet recording apparatus 1. The CPU 15 realizes various processes by executing a program. The CPU 15 is electrically connected to the program memory 16, the RAM 17, the communication I/F 18, the head controller 19, and the control board 20 in the ink jet recording apparatus 1. The CPU 15 is configured to output an operation instruction to each unit of the ink jet recording apparatus 1 according to an operation command from an external device and to notify the external device of various information acquired from each unit.

For example, the CPU 15 performs various processes by using the RAM 17 and executing a program stored in the program memory 16.

The program memory 16 is a storage unit. The program memory 16 is, for example, a read only memory (ROM), and is a non-rewritable nonvolatile memory that stores a program, control data, and the like.

The RAM 17 is a storage unit. The RAM 17 is formed of a volatile memory. The RAM 17 is, for example, a working memory. The RAM 17 stores, for example, a setting value used when the heater 36 heats the ink 90. As a specific example, the RAM 17 stores, as the setting value used when heating the ink 90, a target temperature of the ink 90 and a threshold value which is a temperature (an upper limit temperature) with which the heater 36 is determined to be abnormal. As the threshold value, an upper limit value of the temperature of the heater 36 itself is set. However, the threshold value is appropriately set considering the type of the ink 90, a peripheral configuration, safety, and the like. As a specific example, the threshold value is the temperature of the heater 36 which can avoid damage to peripheral parts existing around the heater 36 or destruction of the device.

As illustrated in FIG. 3, the communication I/F 18 is an interface configured to communicate with the external device such as a host control device 100. For example, the communication I/F 18 receives printing data in response to a print request from the external device. The communication I/F 18 is electrically connected to the CPU 15 and configures an interface that transmits and receives data to and from the external device.

As illustrated in FIG. 3, the head controller 19 drives the liquid discharge head 12 based on an instruction from the CPU 15. The head controller 19 is electrically connected to a drive circuit 12*f* of the liquid discharge head 12.

As illustrated in FIG. 3, the CPU 15, the program memory 16, the RAM 17, the communication I/F 18, and the head controller 19 are mounted on the control board 20. The control board 20 is contained, for example, in the case 14, and electrically connected to the first pump 22, the first pressure sensor 24, the first valve 25, the second pump 32, the second pressure sensor 34, and the second valve 35. The control board 20 includes a drive circuit 20*a* that receives a signal of a pressure value transmitted from the first pressure sensor 24 and the second pressure sensor 34 and drives and controls the first pump 22, the first valve 25, the second pump 32, and the second valve 35.

Figure 4:
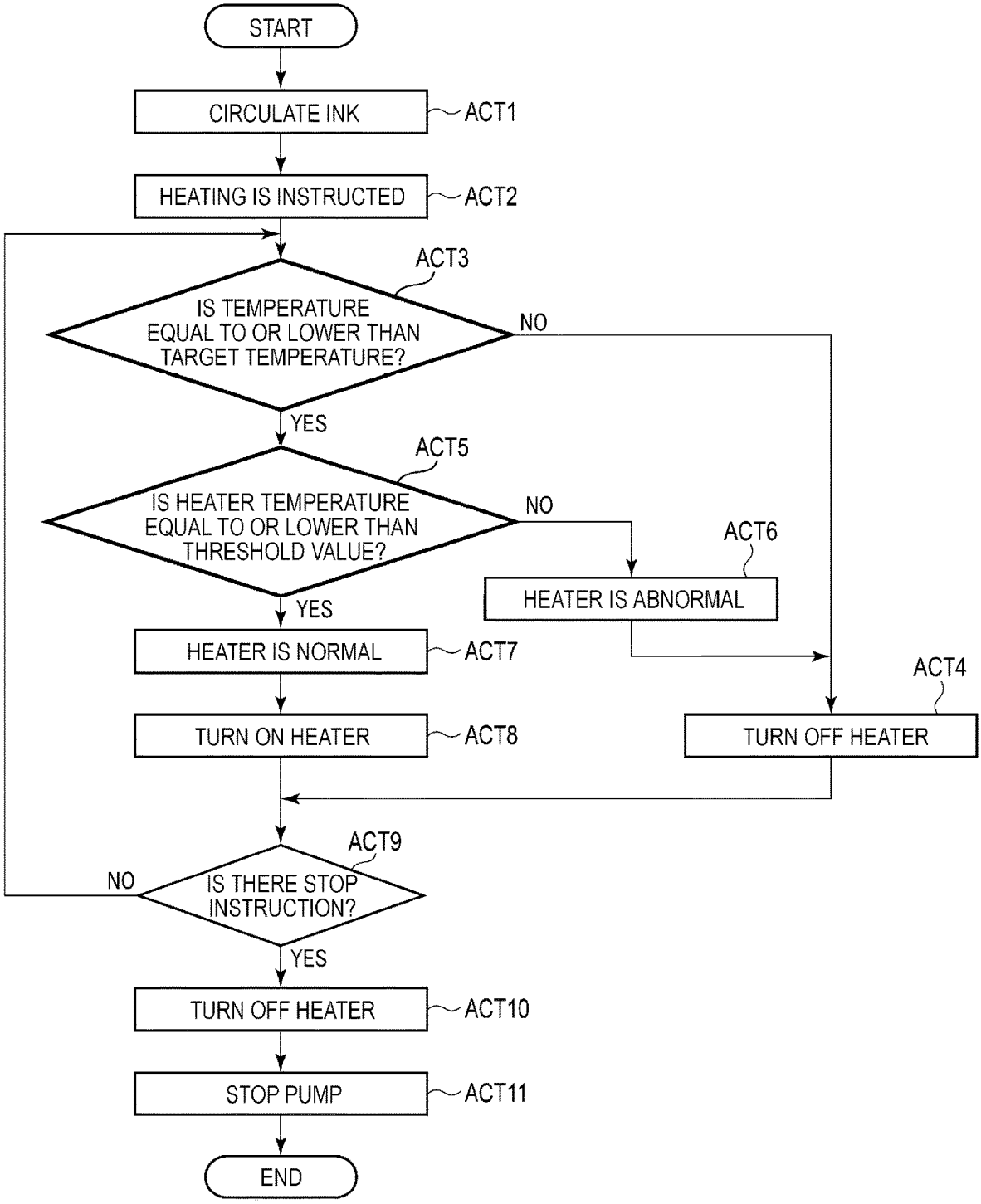
FIG. 4 is a flowchart illustrating an example of control of an ink circulation device provided in the ink jet recording apparatus.

Next, as a specific example of the processes performed by the CPU 15, a process of circulating the ink 90 and a process of controlling the temperature of the ink 90 will be described below. FIG. 4 is a flowchart illustrating a flow of a process of controlling the temperature of the ink 90 of the ink circulation device 13 provided on the ink jet recording apparatus 1.

First, if the liquid discharge device 1 is activated, the CPU 15 drives the ink circulation device 13 and circulates the ink (liquid) 90 between the tank 11 and the liquid discharge head 12 (Act 1). As a specific example, the CPU 15 drives the first pump 22 and the second pump 32, supplies the ink 90 in the tank 11 to the liquid discharge head 12, and returns the ink of the liquid discharge head 12 to the tank 11.

Next, if an instruction to heat the ink 90 is received from the host control device 100 and the like (Act 2), the CPU 15 determines whether the temperature (a detected value) detected by the first temperature sensor 37 is equal to or lower than the target temperature of the ink 90 stored in the RAM 17 (Act 3). If the temperature of the ink 90, detected by the first temperature sensor 37 is higher than the target temperature of the ink 90 (NO in Act 3), the CPU 15 turns the heater 36 off or keeps the heater 36 off (Act 4).

If the temperature of the ink 90 detected by the first temperature sensor 37 is equal to or less than the target temperature of the ink 90 (YES in Act 3), the CPU 15 determines whether the temperature (a detected value) of the heater 36 detected by the second temperature sensor 38 is equal to or less than threshold value stored in the RAM 17 (Act 5). If the temperature of the heater 36 detected by the second temperature sensor 38 is higher than the threshold value (NO in Act 5), the CPU 15 determines that the heater 36 is abnormal (Act 6) and turns the heater 36 off or keeps the heater 36 off (Act 4). If the temperature of the heater 36, detected by the second temperature sensor 38 is equal to or lower than the threshold value (YES in Act 5), the CPU 15 determines that the heater 36 is normal (Act 7) and turns the heater 36 on or keeps the heater 36 on (Act 8).

Next, the CPU 15 determines whether there is a stop instruction (Act 9). Here, examples of the stop instruction include an external command from the host control device 100 or the like and a stop instruction issued by a program or the like when an abnormality in the temperature detected by the first temperature sensor 37 and the second temperature sensor 38 is detected. Examples of the stop instruction include an instruction to stop the heating of the ink 90 by the heater 36 and an instruction to stop the circulation of the ink 90. In the present embodiment, the stop instruction is, for example, an instruction to stop the circulation of the ink 90 from the host control device 100.

If there is no instruction to stop the circulation of the ink 90 (NO in Act 9), the process returns to Act 3, and the CPU 15 repeatedly performs the heating control processes of the ink 90. If there is the instruction to stop the circulation of the ink 90 (YES in Act 9), the CPU 15 turns the heater 36 off or keeps the heater 36 off (Act 10), and stops the first pump 22 and the second pump 32 (Act 11).

The ink jet recording apparatus 1 configured in this manner includes the heater 36 provided on the first flow channel pipe 21, on the primary side of the liquid discharge head 12 and the secondary side of the first pump 22. Accordingly, the ink 90 supplied to the liquid discharge head 12 can be heated.

The ink jet recording apparatus 1 is provided with the first temperature sensor 37 on the secondary side of the liquid discharge head 12, and configured to heat the ink 90 by the heater 36 if the temperature detected by the first temperature sensor 37 is equal to or lower than the target temperature of the ink 90. The ink jet recording apparatus 1 having the configuration can control the heater 36 based on the temperature of the ink 90 detected by the first temperature sensor 37 correlated with the temperature of the ink 90 in the liquid discharge head 12.

Figure 5:
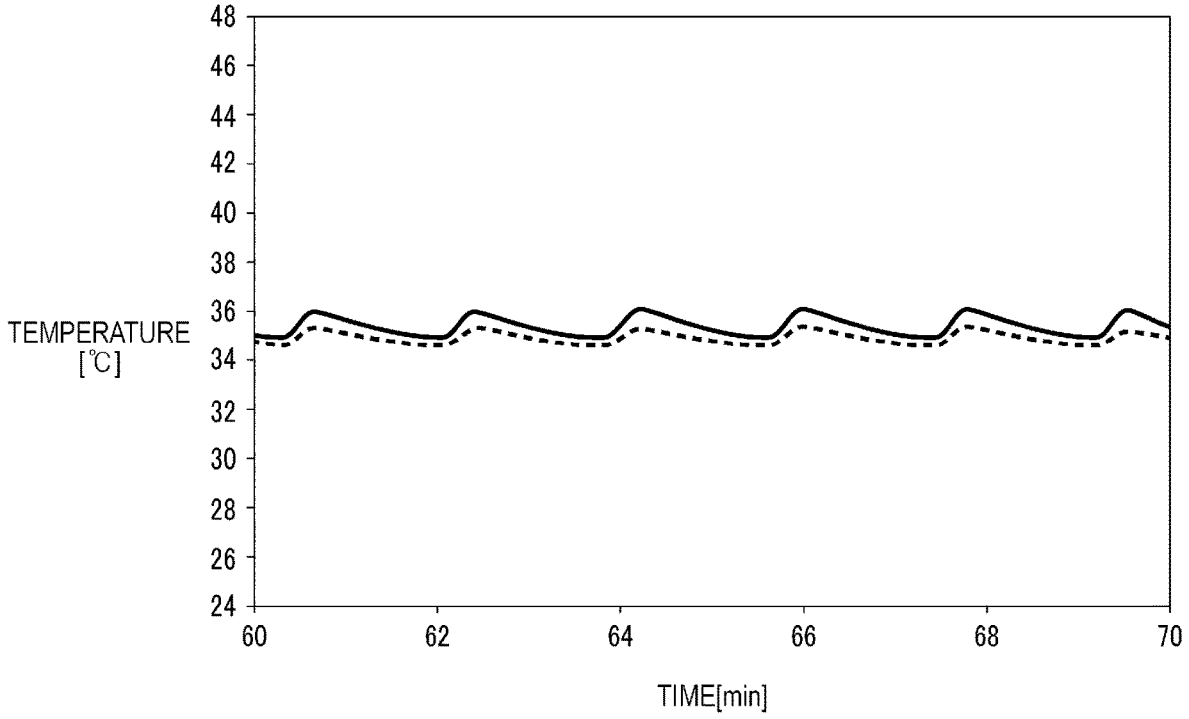
FIG. 5 is an explanatory diagram illustrating a correlation between ink temperatures in the ink circulation device and a liquid discharge head.

FIG. 5 is an explanatory diagram illustrating the temperature of the ink 90 detected by the first temperature sensor 37 as a solid line, and illustrating the temperature of the ink 90 in the liquid discharge head 12 detected by a thermistor provided in the liquid discharge head 12 as a broken line. As illustrated in FIG. 5, it can be seen that there is a correlation between the temperature of the second diameter expanded portion 33 detected by the first temperature sensor 37, and the temperature of the ink 90 in the liquid discharge head 12 detected by the thermistor.

In this manner, the ink jet recording apparatus 1 controls on and off of the heater 36 based on the temperature of the ink 90 detected by the first temperature sensor 37. Accordingly, the heater 36 can be controlled based on the temperature of the ink 90 even if a unit configured to detect a temperature such as a temperature sensor is not provided on the liquid discharge head 12.

The ink jet recording apparatus 1 can perform feedback control to control the heater 36 by comparing the temperature of the ink 90 detected by the first temperature sensor 37 with the target temperature. In this manner, the inkjet recording apparatus 1 can manage the temperature of the ink 90 such that the ink 90 has an appropriate viscosity. As a result, since the liquid discharge head 12 can discharge the ink 90 accurately and stably, the ink jet recording apparatus 1 can obtain high printing performance.

If the temperature of the heater 36 detected by the second temperature sensor 38 is compared with the threshold value which is a temperature with which the heater 36 is determined to be abnormal and the detected temperature of the heater 36 is equal to or higher than the threshold value, the ink jet recording apparatus 1 determines that the heater 36 is abnormal and turns the heater 36 off. According to the configuration, the ink jet recording apparatus 1 can avoid damage to a peripheral part existing around the heater 36 or destruction of the device due to excessive heating by abnormal heating of the heater 36. As a result, the ink jet recording apparatus 1 can ensure high safety.

As described above, according to the ink jet recording apparatus 1 according to an exemplary embodiment, the liquid (ink 90) can be heated to an appropriate temperature.

Figure 6:
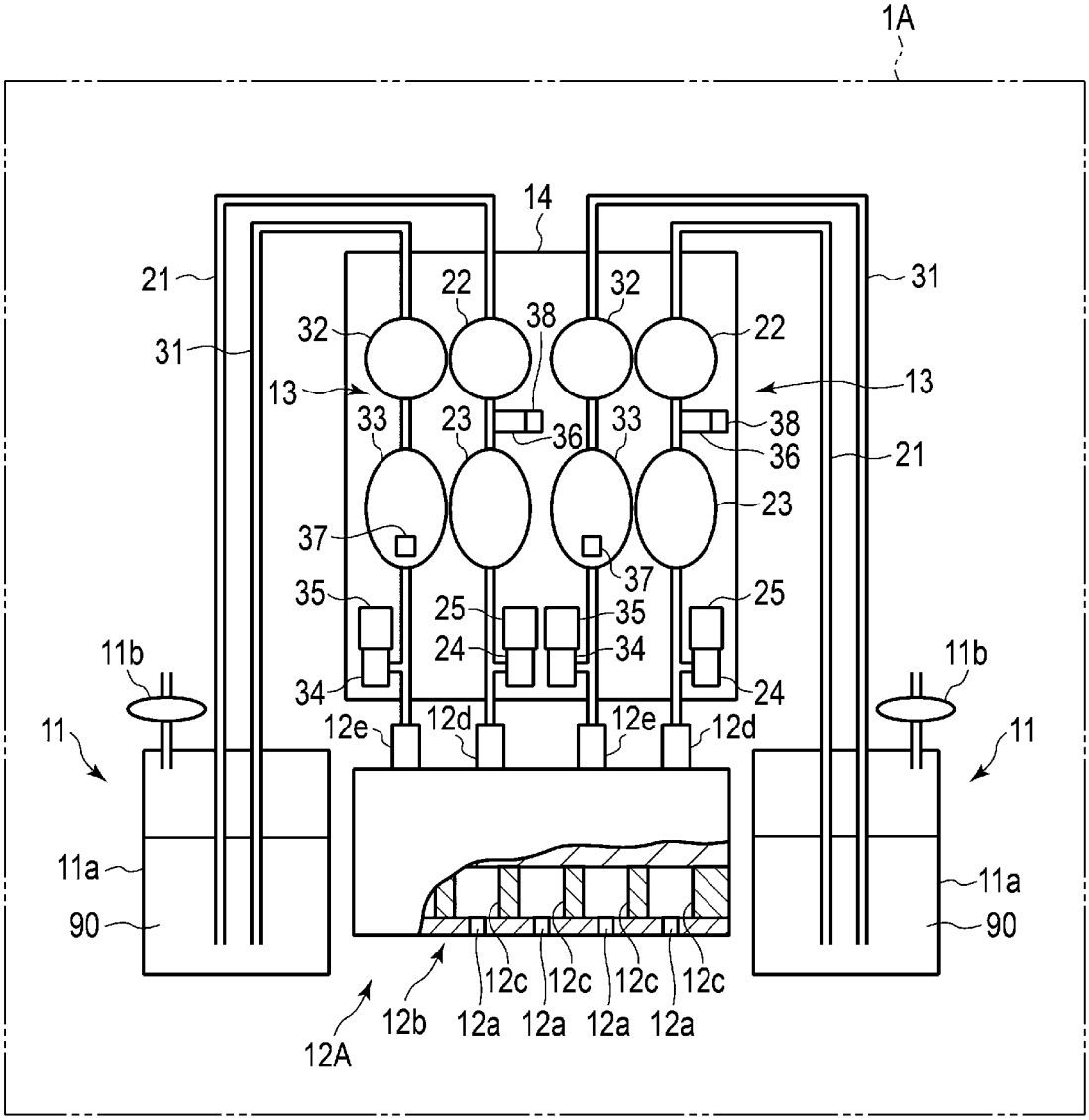
FIG. 6 is an explanatory diagram illustrating a configuration of an ink jet recording apparatus according to a second embodiment.

The present disclosure is not limited to the exemplary embodiments, and at a stage of embodying, the embodiment can be realized by modifying each component without departing from the spirit of the present disclosure. For example, in the example, a description was given of a configuration including one tank 11, one ink circulation device 13, and one liquid discharge head 12, but the present disclosure is not limited thereto. The ink jet recording apparatus 1 may have a configuration capable of discharging various types of ink. As a specific example, as in an ink jet recording apparatus 1A according to a second embodiment illustrated in FIG. 6, two tanks 11, one liquid discharge head 12A, and two ink circulation devices 13 configured to circulate the two tanks 11 and the liquid discharge head 12A may be provided to discharge two different types of the ink 90.

Similarly, an ink jet recording apparatus configured to jet four colors of the ink 90 may include four tanks 11, two liquid discharge heads 12A, four ink circulation devices 13, and two cases 14. That is, according to the color and type of the ink 90 to be used, an ink jet recording apparatus capable of jetting multi-kinds or multi-colors of the ink 90 can be provided by appropriately combining the components.

In the examples, a description was given of a configuration in which the RAM 17 stores the target temperature and the threshold value of the ink 90, but the present disclosure is not limited thereto. For example, the threshold value used for determining the abnormality of the heater 36 may be stored in the program memory 16 to obtain a configuration in which the threshold value cannot be set. For example, the target temperature of the ink 90 may be rewritable by setting by the host control device 100 or the like.

In the examples, a description was given of control of the CPU 15 that turns the heater 36 on and off, but the present disclosure is not limited thereto. For example, the CPU 15 may change the heating temperature of the heater 36. If the configuration is adopted, the CPU 15 may perform feedback control to change the heating temperature of the heater 36 based on the temperature of the ink 90 detected by the first temperature sensor 37.

In addition to the configuration of the ink jet recording apparatuses 1 and 1A in the examples, a moving mechanism configured to move the liquid discharge head 12 may further be provided. In addition to the configuration of the ink jet recording apparatuses 1 and 1A in the examples, a transport motor configured to transport the recording medium, a carriage motor configured to control a position of the liquid discharge head 12, and the like may further be provided. The liquid used in the ink jet recording apparatuses 1 and 1A is not limited to the ink 90, and the present disclosure can be applied for a liquid discharge device that discharges a liquid other than the ink 90. Examples of the liquid discharge device using the liquid other than the ink 90 may include a device that discharges a liquid containing conductive particles configured to form a wiring pattern of a printed wiring board.

The liquid discharge device can be used, for example, in a 3D printer, an industrial manufacturing machine, and a medical application. The actuator of the liquid discharge head 12 may be configured to change the pressure chamber 12*c* by electrically deforming the diaphragm and may be configured to discharge the ink 90 from the nozzle using thermal energy of heater and the like.

In the examples, a description was given of a configuration in which the CPU 15 determines the normal or abnormal of the heater 36 by determining the temperature of the heater 36 detected by the second temperature sensor 38 and the threshold value, but the present disclosure is not limited thereto. For example, after determining that the heater 36 is normal or abnormal, the CPU 15 may transmit the determined information to the host control device 100 and display a state of the heater 36 on the host control device 100.

In the examples, a description was given of the liquid discharge device 1 including the program memory 16 and the RAM 17 as a storage unit. However, the present disclosure is not limited thereto, and another storage device may be provided.

In the examples, a description was given of a configuration in which the CPU 15 controls the whole ink jet recording apparatus 1, but the present disclosure is not limited thereto. For example, the CPU 15 may control only the ink circulation device 13 and the other configurations in the ink jet recording apparatus 1 may be processed by a processing device that is a processor other than the CPU 15. In the examples, a description was given of a configuration using the CPU 15 as the processor, but the processor is not limited to the CPU 15 and can be set as appropriate.

According to the liquid circulation device and the liquid discharge device according to at least one exemplary embodiment described above, the liquid can be heated to an appropriate temperature.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid circulation device comprising:

a first flow channel pipe having a secondary side connected to a liquid discharge head configured to discharge a liquid;

a first pump provided approximately midway through the first flow channel pipe;

a first diameter expanded portion provided approximately midway through the first flow channel pipe on a secondary side of the first pump, the first diameter expanded portion including a flow channel cross-sectional area larger than a flow channel cross-sectional area of the first flow channel pipe;

a second flow channel pipe having a primary side connected to the liquid discharge head;

a second pump provided approximately midway through the second flow channel pipe;

a second diameter expanded portion provided approximately midway through the second flow channel pipe on a primary side of the second pump, the second diameter expanded portion including a flow channel cross-sectional area larger than a flow channel cross-sectional area of the second flow channel pipe;

a heater provided on a primary side of the liquid discharge head and configured to heat the liquid;

a heater temperature sensor provided to the heater;

a storage unit that stores an upper limit temperature of the heater; and a control unit that stops the heater from heating the liquid if a first detected value detected by the heater temperature sensor exceeds the upper limit temperature of the heater.

2. The device according to claim 1, further comprising:

a temperature sensor provided on a secondary side of the liquid discharge head and configured to detect a temperature of the liquid.

3. The device according to claim 2, further comprising:

the storage unit configured to store a target temperature of the liquid; and the control unit configured to control the heater based on a second detected value detected by the temperature sensor and the target temperature.

4. The device according to claim 3, further comprising:

the heater temperature sensor provided to the heater, wherein the storage unit stores an upper limit temperature of the heater, and the control unit stops the heater from heating the liquid if the first detected value detected by the heater temperature sensor exceeds the upper limit temperature of the heater.

5. The device according to claim 1, further comprising:

a first pressure sensor that detects pressure of the ink in the first flow channel pipe; and a second pressure sensor that detects pressure of the ink in the second flow channel pipe.

6. The device according to claim 1, wherein the heater is further provided on the first flow channel pipe.

7. A liquid discharge device comprising:

a liquid discharge head configured to discharge a liquid;

a first flow channel pipe having a secondary side connected to the liquid discharge head;

a first pump provided approximately midway through the first flow channel pipe;

a first diameter expanded portion provided approximately midway through the first flow channel pipe on a secondary side of the first pump, the first diameter expanded portion including a flow channel cross-sectional area larger than a flow channel cross-sectional area of the first flow channel pipe;

a second flow channel pipe having a primary side is connected to the liquid discharge head;

a second pump provided approximately midway through the second flow channel pipe;

a second diameter expanded portion provided approximately midway through the second flow channel pipe on a primary side of the second pump, the second diameter expanded portion including a flow channel cross-sectional area larger than a flow channel cross-sectional area of the second flow channel pipe;

a heater provided on a primary side of the liquid discharge head and configured to heat the liquid;

a heater temperature sensor provided to the heater;

a storage unit that stores an upper limit temperature of the heater; and a control unit that stops the heater from heating the liquid if a first detected value detected by the heater temperature sensor exceeds the upper limit temperature of the heater.

8. The device according to claim 7, further comprising:

a temperature sensor provided on a secondary side of the liquid discharge head and configured to detect a temperature of the liquid.

9. The device according to claim 8, further comprising:

the storage unit configured to store a target temperature of the liquid; and the control unit configured to control the heater based on a second detected value detected by the temperature sensor and the target temperature.

10. The device according to claim 9, further comprising:

the heater temperature sensor provided to the heater, wherein the storage unit stores an upper limit temperature of the heater, and the control unit stops the heater from heating the liquid if the first detected value detected by the heater temperature sensor exceeds the upper limit temperature of the heater.

11. The device according to claim 7, further comprising:

a first pressure sensor that detects pressure of the ink in the first flow channel pipe; and a second pressure sensor that detects pressure of the ink in the second flow channel pipe.

12. The device according to claim 7, wherein the heater is further provided on the first flow channel pipe.

13. An inkjet printer, comprising:

a paper cassette;

a paper conveying mechanism; and a liquid discharge device comprising:

a liquid discharge head configured to discharge a liquid;

a first flow channel pipe having a secondary side connected to the liquid discharge head;

a first pump provided approximately midway through the first flow channel pipe;

a first diameter expanded portion provided approximately midway through the first flow channel pipe on a secondary side of the first pump, the first diameter expanded portion including a flow channel cross-sectional area larger than a flow channel cross-sectional area of the first flow channel pipe;

a second flow channel pipe having a primary side is connected to the liquid discharge head;

a second pump provided approximately midway through the second flow channel pipe;

a second diameter expanded portion provided approximately midway through the second flow channel pipe on a primary side of the second pump, the second diameter expanded portion including a flow channel cross-sectional area larger than a flow channel cross-sectional area of the second flow channel pipe;

a heater provided on a primary side of the liquid discharge head and configured to heat the liquid;

a heater temperature sensor provided to the heater;

a storage unit that stores an upper limit temperature of the heater; and a control unit that stops the heater from heating the liquid if a first detected value detected by the heater temperature sensor exceeds the upper limit temperature of the heater.

14. The inkjet printer according to claim 13, the liquid discharge device further comprising:

a temperature sensor provided on a secondary side of the liquid discharge head and configured to detect a temperature of the liquid.

15. The inkjet printer according to claim 14, the liquid discharge device further comprising:

the storage unit configured to store a target temperature of the liquid; and the control unit configured to control the heater based on a second detected value detected by the temperature sensor and the target temperature.

16. The inkjet printer according to claim 15, the liquid discharge device further comprising:

the heater temperature sensor provided to the heater, wherein the storage unit stores an upper limit temperature of the heater, and the control unit stops the heater from heating the liquid if the first detected value detected by the heater temperature sensor exceeds the upper limit temperature of the heater.

17. The inkjet printer according to claim 13, the liquid discharge device further comprising:

a first pressure sensor that detects pressure of the ink in the first flow channel pipe; and a second pressure sensor that detects pressure of the ink in the second flow channel pipe.

* * * * *